US008490567B2

(12) United States Patent
Yamaguchi et al.

(10) Patent No.: US 8,490,567 B2
(45) Date of Patent: Jul. 23, 2013

(54) APPARATUS FOR COUPLING A PUSHBOAT TO A BARGE

(75) Inventors: Takuma Yamaguchi, Funabashi (JP); Kiyoshi Mogami, Koshigaya (JP); Robert P. Hill, Milford, MA (US)

(73) Assignee: Taisei Engineering Consultants, Inc., Tokyo (JP)

( * ) Notice: Subject to any disclaimer, the term of this patent is extended or adjusted under 35 U.S.C. 154(b) by 211 days.

(21) Appl. No.: 13/002,925

(22) PCT Filed: Jul. 15, 2008

(86) PCT No.: PCT/JP2008/001897

§ 371 (c)(1),
(2), (4) Date: Jan. 6, 2011

(87) PCT Pub. No.: WO2010/007644

PCT Pub. Date: Jan. 21, 2010

(65) Prior Publication Data

US 2011/0120363 A1 May 26, 2011

(51) Int. Cl.
*B63B 21/58* (2006.01)

(52) U.S. Cl.
USPC ..... 114/249

(58) Field of Classification Search
USPC ..... 114/242, 246, 247, 248, 249, 250, 114/252; 331/242, 246, 247, 248, 249, 250, 331/252
See application file for complete search history.

(56) References Cited

U.S. PATENT DOCUMENTS

| | | | | |
|---|---|---|---|---|
| 3,512,495 | A | 5/1970 | Fletcher | |
| 3,645,225 | A * | 2/1972 | Lunde | 114/246 |
| 3,788,261 | A * | 1/1974 | Colin | 114/249 |
| 3,844,245 | A | 10/1974 | Yamaguchi | |
| 3,910,219 | A * | 10/1975 | Ono et al. | 114/248 |
| 3,935,831 | A | 2/1976 | Yamaguchi | |
| 4,177,964 | A * | 12/1979 | Hujsak et al. | 244/172.4 |
| 4,256,049 | A * | 3/1981 | Brunet et al. | 114/77 R |
| 3,512,495 | B1 | 11/1983 | Fletcher | |
| 4,688,507 | A | 8/1987 | Kuhlman et al. | |
| 4,805,548 | A | 2/1989 | Yamaguchi | |
| 5,050,522 | A * | 9/1991 | Yamaguchi et al. | 114/249 |
| 6,487,985 | B1 * | 12/2002 | Kuhlman | 114/248 |
| 6,612,253 | B1 * | 9/2003 | Kuhlman | 114/249 |
| 2005/0016433 | A1 * | 1/2005 | Laiho | 114/249 |

FOREIGN PATENT DOCUMENTS

| | | |
|---|---|---|
| EP | 0 076 325 A1 | 4/1983 |
| EP | 0 415 434 A1 | 3/1991 |

* cited by examiner

*Primary Examiner* — Stephen Avila
*Assistant Examiner* — Andrew Polay
(74) *Attorney, Agent, or Firm* — Foley & Lardner LLP

(57) ABSTRACT

Apparatus for coupling a pushboat to a barge having a notch in its stern for receiving the bow of pushboat. The pushboat has three coupler units, two on the opposite sides and one at the bow end, each of which has an extensible and retractable connecting pin. The side connecting pin has hemi-spherical part at its outer end part which comes into tight contact with the similar hemi-spherical part of the holes in side socket on the side wall of the notch when it is extended out and inserted into the hole for connection. The bow connecting pin has wedge-shaped end which engages with the teeth of the center rack located in the barge's centerline at the deepest point of the notch when it is extended out for connection. The motions of connecting pins are remotely controlled from a control panel located in the navigation bridge.

5 Claims, 5 Drawing Sheets

APPARATUS FOR COUPLING A PUSHBOAT TO A BARGE

BACKGROUND OF THE INVENTION

The present invention relates to a coupling device of a type which serves to couple a pushboat to a barge.

Barges have long been used to transport various types of cargo in rivers, lakes and harbors, and even in open sea. There are two conventional methods to maneuver the barge, one being to tow by a tugboat and the other being to push by a pushboat. The present invention relates to the latter case where the barge is connected with the pushboat to form a pusher-barge combination, and the present invention relates to an apparatus to couple the pushboat to the barge to form an improved type of pusher-barge combination with super-excellent performance.

The method of connecting the pushboat to the barge with ropes has widely been employed, and this connection method is being widely used in calm rivers. But the performance of this type of combination is quite limited in wavy sea and, to solve this problem, various types of mechanical connection have been developed, as exemplified by U.S. Pat. No. 3,512,495 to Fletcher, U.S. Pat. Nos. 3,844,245, 3,935,831 and 4,805,548 to Yamaguchi and U.S. Pat. No. 4,688,507 to Kuhlman and Hill. All these inventions have been of a type that the barge has a recess or notch at its stern to receive the bow of the pushboat which has, on its two sides, two so-axial connecting pins extensible and retractable by hydraulic or electric means and, when these pins are extended out, their ends are supported by supporting means on the side walls of said recess or notch so that said pushboat and said barge may form an articulately connected combination permitting free pitching of said pushboat relative to said barge in wave.

The performances of these articulate combinations are so satisfactory and reliable as to realize ocean-going service of pusher-barge combinations and many combinations of these types are being operated now. But these types of combinations still involve two demerits, one being the heavy relative pitching of the pushboat caused by the pitching of the barge and another being the low speed due to heavy eddies occurring at the bottom part of the connecting part where a wide clearance is needed between two hull to permit free relative pitching of the pushboat. The present invention is proposed in order to give solution to these problems involved in the above-mentioned articulated type of pusher-barge combination.

SUMMARY OF THE INVENTION

The object of the present invention is to provide an improved coupling device which gives solutions to the aforementioned problems and realizes highly seaworthy pusher-barge combinations comfortable to the crew members on board and opening the possibility to attain high running speed.

In accordance with the invention, the opposite sides of the pushboat are each equipped with a coupler unit and, in addition, the bow end of said pushboat is equipped with an additional coupler unit, each coupler unit having an extensible and retractable connecting pin. The outer head of the side connecting pin of each side coupler unit has a hemi-spherical head with a conical pointed tip, while the bow connecting pin of the bow coupler unit has a wedge-shaped outer end.

Each connecting pin is axially extended out and retracted in by the function of an actuating power means, which, in this case, is a large actuator screw turned in an internally threaded ring carried on the connecting pin by a rotary power motor, such as a hydraulic motor energized by pressure oil from a hydraulic pump unit under remote-control from the control panel in the navigation bridge.

Alternatively, each connecting pin can be arranged for actuation in axial extension and retraction by means of a hydraulic cylinder in the connecting pin itself which is supplied with pressure oil from a similar hydraulic pump unit.

The barge has a deep notch in its stern portion to receive the bow portion of the pushboat, and each side wall of said notch has a vertically elongated socket with shallow conical holes stepwise arranged vertically from top to bottom for receiving and supporting the end of the side connecting pin extended from the pushboat. The entrance part of each said hole is shaped hemi-spherically with a same radius as that of the hemi-spherical part at the head of said side connecting pin to assure a perfect contact with it without adverse influence of probable misalignment inevitable in welded construction, and the deeper part of the hole enlarged in diameter to avoid contact with the pointed tip part of said side connecting pin.

At the deepest point of the notch, a vertically extending center rack having vertically arranged teeth is provided to engage with and support the outer wedge-shaped end of the connecting pin of the bow coupler unit when it is extended out. The end of the bow connecting pin is supported by the teeth of the rack vertically, but its transverse horizontal slide is permitted in order that the whole combination will form a statically determinate system.

In the accompanying drawings which form a part of the specification and are to be read in conjunction therewith and in which like reference numbers are used to indicate like parts in the various views:

DETAILED DESCRIPTION OF PREFERRED EMBODIMENTS

Figure 1:
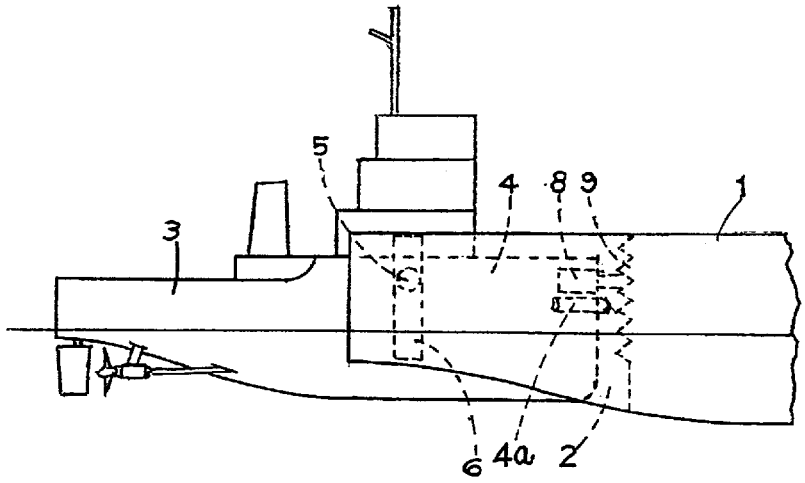
FIG. 1 is a side elevational view showing a pushboat coupled to the barge by the coupling apparatus of the present invention, with the barge being shown only fragmentarily.
Figure 2:
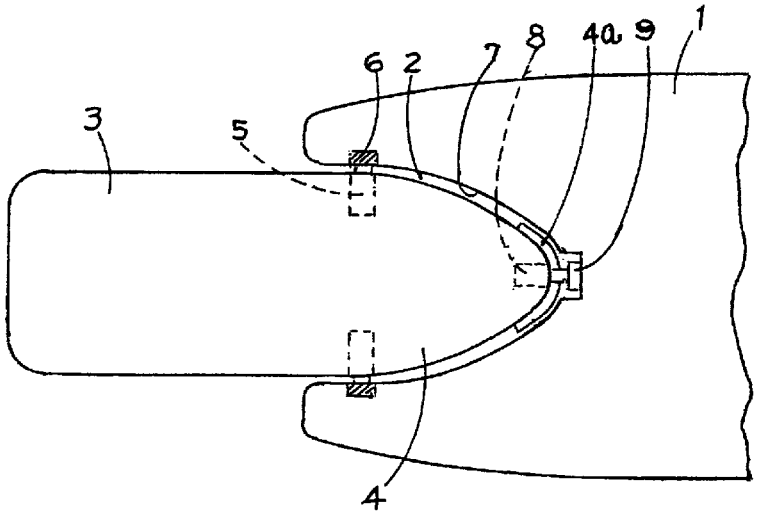
FIG. 2 is a plan view of the combination of the pushboat and the barge shown in elevational view in FIG. 1.

Referring now to FIGS. 1 and 2, the barge 1 is provided with a notch 2 at its stern portion for receiving the bow 4 of the pushboat 3. The configuration and size of the notch 2 is such that, when the pushboat 3 is connected to the barge 1, a proper clearance may be left between the bow 4 of said pushboat 3 and the notch 2 of said barge 1. In accordance with the present invention, each side of the pushboat 3 is equipped with a side coupler unit generally designated by numeral 5, and in order to couple the pushboat 3 to the barge 1, the side coupler units 5 cooperate with side sockets 6 located on the opposite side walls 7 of the stern notch 2. In addition, the pushboat 3 has, at the bow end, a bow coupler unit 8 which cooperates with the center rack 9 located in the centerline at the deepest point of the notch 2. The side socket 6 and the center rack 9 have a vertical length dependent upon the particulars of the barge on which they are installed.

Figure 3:
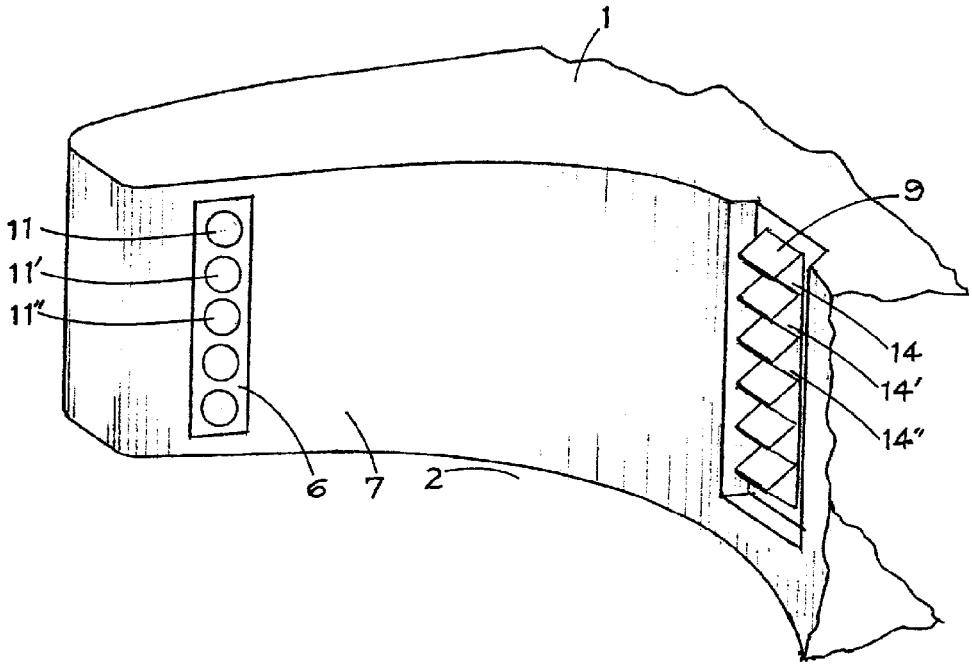
FIG. 3 is a perspective view of the port-side wall of the notch of the barge showing the side socket and the center rack.
Figure 4:
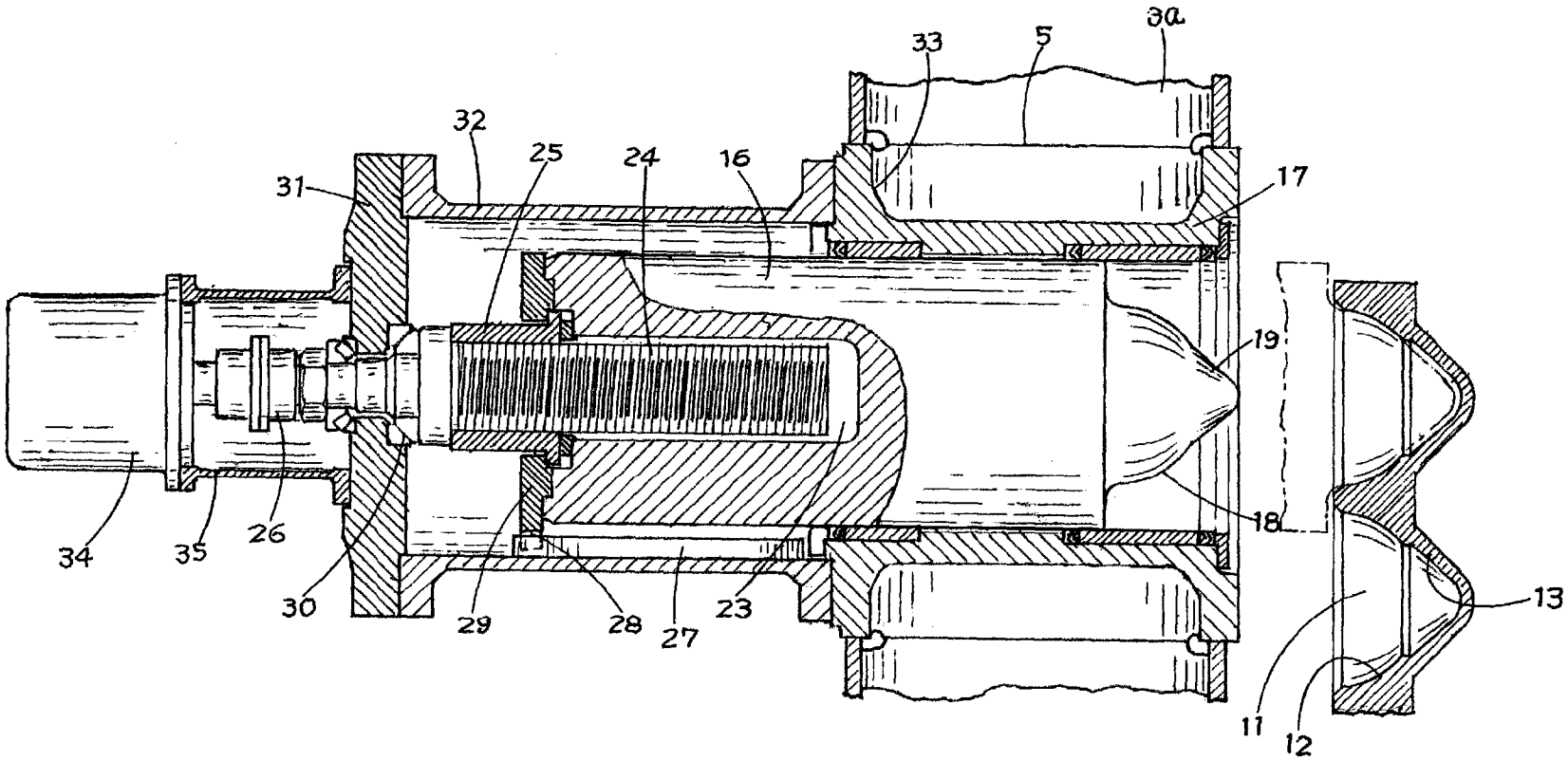
FIG. 4 is an elevational partial sectional view of a side coupler unit and a side socket, where the operating power means consists of an internally threaded ring and an actuator screw.

Referring additionally to FIGS. 3, 4 and even 6, each side socket 6 is a cast member recessed into the side wall 7 of the stern notch 2. Each side socket 6 has a necessary vertical depth and has shallow circular holes 11, 11', 11", . . . stepwise arranged from top to bottom. Each of these holes 11, 11', 11", . . . is a generally conical concave as shown in the cross-sectional plan of FIG. 4 and has, near its entrance, a concaved hemi-spherical part 12, and its deeper concaved conical part 13 up to the bottom is slightly enlarged in diameter. The center rack 9 is a vertical row of teeth 14, 14', 14", . . . fixed to the wall of the stern notch 2 at the barge's centerline.

As shown in FIGS. 4, each side coupler unit 5 has a cylindrical side connecting pin 16 which is supported by and slides along a long bearing 17 transversely placed symmetrically with respect to the ship's centerline and fixed to the hull 3*a* of pushboat 3. The outer end part of the side connecting pin 16 is shaped as a hemi-spherical head 18 with a conical pointed tip 19, and the radius of the hemi-spherical head 18 is same as the radius of the concaved hemi-spherical part 12 of each of holes 11, 11', 11", . . . When the side connecting pin 16 is axially extended out and its outer end part is inserted into any of holes 11, 11', 11", . . . for connection, the contact of the side connecting pin 16 and the hole 11 occurs at their spherical parts, 18 and 12, to absorb adverse influence of any probable misalignment due to welding of surrounding structures and the conical pointed tip 19 does not contact the concaved conical part 13 in the bottom of hole 11.

Figure 6:
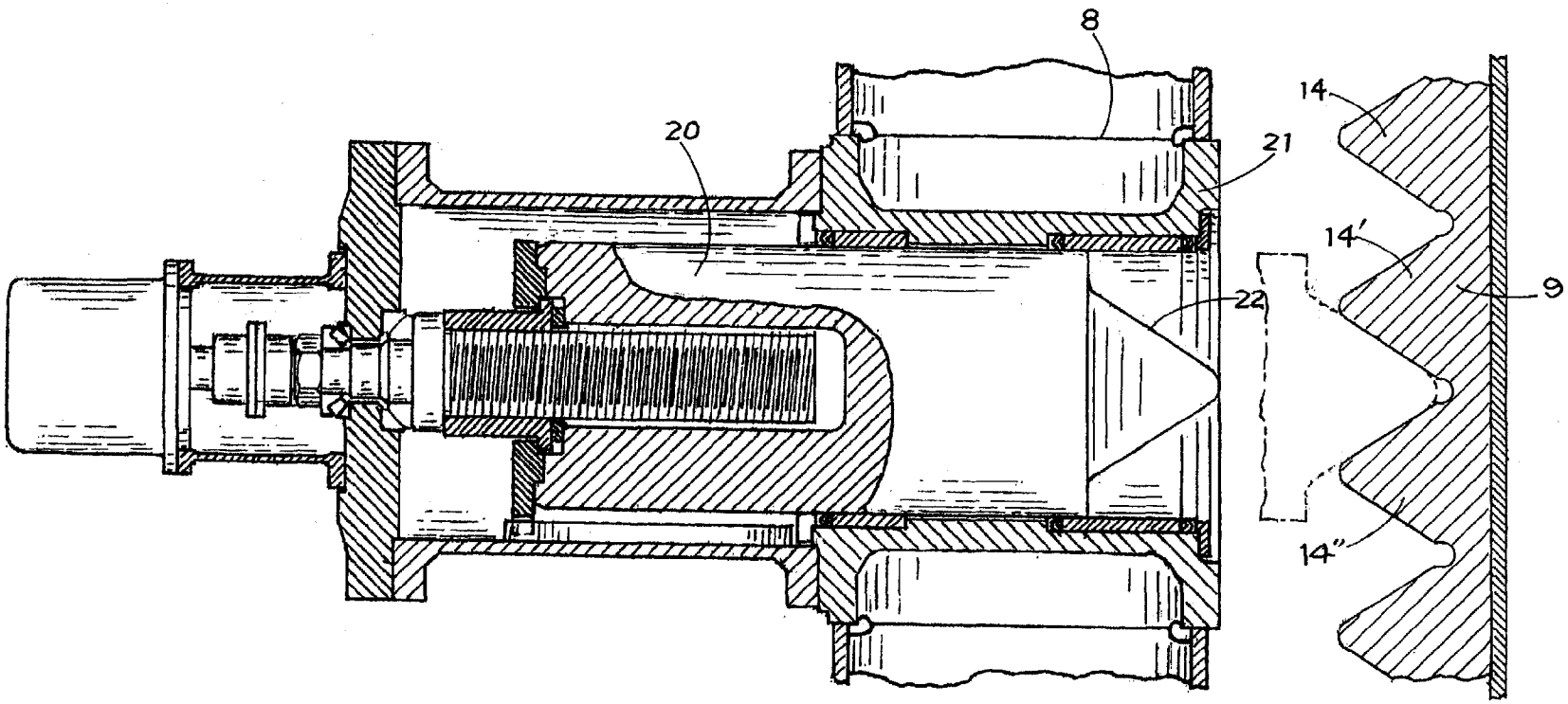
FIG. 6 is an elevational partial sectional view of a bow coupler unit and a center rack, where the operating power means consists of an internally threaded ring and an actuator screw.

Similarly the bow coupler unit 8 has, as shown in FIG. 6, a cylindrical bow connecting pin 20 which is supported by and slides along a long bearing 21 longitudinally placed at the bow end of the pushboat 3 in its centerline. The outer end part of the bow connecting pin 20 is a wedge-shaped end 22 which will engage with an aperture between two adjacent teeth, 14' and 14" for example, of the center rack 9 when the bow connecting pin 20 is extended out for connection.

FIG. 4 shows the mechanism for axial extension and retraction of the side connecting pin 16. The side connecting pin 16 has a deep hole 23 at its inboard end part to house an actuator screw 24 which engages with the internally threaded ring 25 fixed to the side connecting pin 16, so that, when the actuator screw 24 is turned by a hydraulic motor 34 through a shaft system 26, the side connecting pin 16 is extended out for connection or retracted in for disconnection guided by the engagement of the guide rib 27 fixed to inside of the connecting tube 32 and the notch 28 in the stopper 29 fixed to the side connecting pin 16. The axial thrust acting on the side connecting pin 16 due to transverse load from the barge is transmitted to the actuator screw 24 through the internally threaded ring 25 and, then, to the spherical thrust bearing 30 in the end cover 31 of the connecting tube 32 so that the transverse load may be finally transmitted to the hull structure through the main bearing body 33. The hydraulic motor 34 is mounted on a foundation 35 which is fixed to the end cover 31 to drive the actuator screw 24 through the shaft system 26. The hydraulic motor 34 is operated by pressure oil supplied from a hydraulic pump unit (not shown in figures) in the pushboat under remote-control from the control panel in the ship's navigation bridge (not shown in figures).

The above-mentioned description referring to FIGS. 4 and 6 relates to the case of operation by means of combination of the hydraulic motor 34, the actuator screw 24 and the internally threaded ring 25, but it is even possible to use an electric motor with reduction gearing (not shown in figures) as the power source of the same function. In addition, the purpose of this type of operating system is to cause axial motion of the connecting pin 16 or 20 and the same axial motion can be realized by a hydraulic cylinder.

Figure 5:
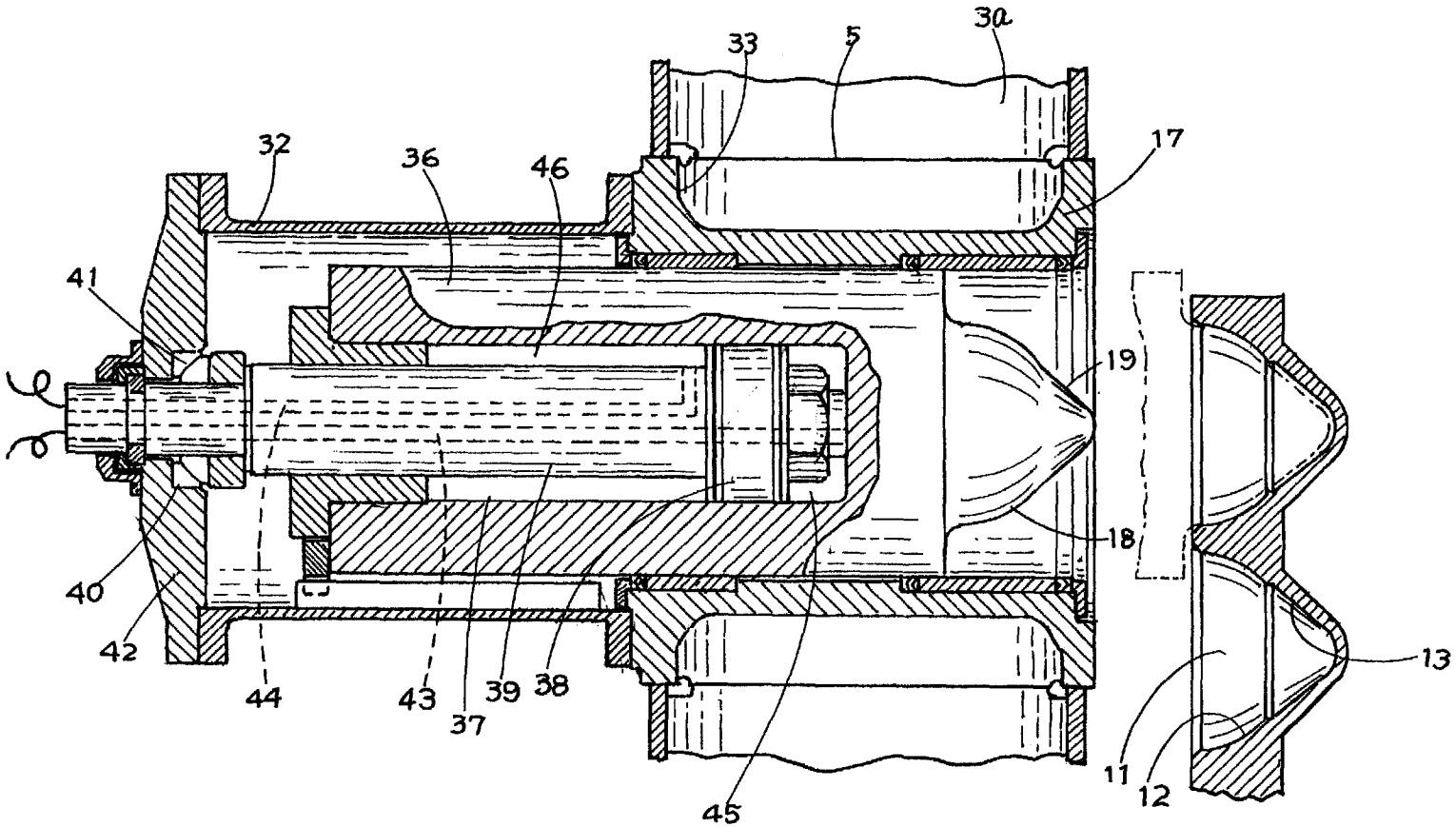
FIG. 5 is an elevational, partial sectional view of a side coupler unit and a side socket, where the operating power means consists of a hydraulic cylinder.

Referring to FIG. 5, the side connecting pin 36 of the side coupler unit 5 contains, at its inboard end, a hydraulic cylinder 37 with the piston 38 and piston rod 39, and the outer end of piston rod 39 is supported by the end cover 42 through a bearing box 40 containing a spherical thrust roller bearing 41 so that the axial load on the side connecting pin 36 coming from the barge may be transmitted through the end cover 42 and the connecting tube 32 to the main bearing body 33 and, then, finally to the hull structure 3*a* of pushboat 3. The piston rod 39 contains two oil ways 43 and 44, both led from the outer end of the piston rod 39 and one oil way 43 is connected to the headside 45 and another oil way 44 to the rodside 46 of the hydraulic cylinder 37, so that pressure oil supplied from the pump unit into the headside 45 will cause extension of the side connecting pin 36 for connection and oil supplied to the rodside 46 will cause its retraction for disconnection. The manners of construction and function of the bow connecting pin by means of a hydraulic cylinder are similar.

Next, the functions and operations of the apparatus for coupling according to the embodiments described above are explained. Before connection, all the side and bow connecting pins 16 and 20, or even 36, are retracted into the side and bow coupler units 5 and 8. After having inserted the bow 4 of pushboat 3 into the stern notch 2 of the barge 1 and the motion of the pushboat has been stopped by contact of its bow fender 4*a* onto the deepest bottom of the notch 2, the side connecting pins 16 are extended out by the function of the hydraulic motors 34 or hydraulic cylinders 37 under remote-control from the control panel in the navigation bridge until their outboard ends enter into any of the holes 11, 11', 11", . . . of the side sockets 6 and come into tight contact with them. Then, the clearances between the hulls of the pushboat 3 and barge 1 on the port and starboard sides are compared visually and, if an appreciable difference has been found, the side coupler units 5 are to be operated to extend one side and retract another side so that the pushboat 3 may come to the center of the notch 2. Then, the bow coupler unit 8 is operated similarly to extend the bow connecting pin 20 until its wedge-shaped outboard end may engage with an aperture between two teeth of the center rack 9 and, thus, the connection is finished. For disconnection, what is needed is to retract the connecting pins 16 and 20 only.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matters herein set forth or shown in the accompanying drawings are to be interpreted as illustrative and not in a limiting sense.

The invention claimed is:

1. An apparatus for coupling a pushboat to a barge, said barge having a notch in a stern portion, said notch shaped to receive a bow portion of said pushboat, said barge having two vertically elongated side sockets recessed in side walls of said notch, having a plurality of holes stepwise arranged from top to bottom and facing each other, and a vertically elongated center rack placed on a centerline of the barge at a deepest point of said notch, and said pushboat having, on both sides of said bow portion, two transversely elongated side connecting pins arranged to be axially extended and retracted via operating power and a longitudinally elongated bow connecting pin arranged to be axially extended and retracted via operating power wherein:

(a) each of the plurality of holes in the side sockets is a circular conical concave hole that has a hemi-spherical part near an entrance;

(b) the center rack has vertically arranged teeth;

(c) an outer end of each of said side connecting pins is shaped as a hemi-spherical head with a conical pointed tip so that when each side connecting pin is extended via operating power and inserted into one of said plurality of holes of said side socket, said hemi-spherical head comes into contact with said hemi-spherical part of said one of said plurality of holes of said side socket;

(d) said bow connecting pin has a wedge-shaped outer end which, when said pin is extended via operating power, engages with corresponding teeth of said center rack.

2. The apparatus according to claim 1, further comprising an internally threaded ring carried on a connecting pin and an actuator screw turned by a rotary power motor through a shaft system.

3. The apparatus according to claim 2, wherein said rotary power motor is a hydraulic motor.

4. The apparatus according to claim 1, further comprising a hydraulic cylinder in a connecting pin.

5. The apparatus according to claim 1, wherein said operating power is put into function under remote-control from a control panel in a navigation bridge.

* * * * *